US007938395B2

(12) United States Patent
Yoshida et al.

(10) Patent No.: US 7,938,395 B2
(45) Date of Patent: May 10, 2011

(54) SHEET FEEDING DEVICE

(75) Inventors: Shoji Yoshida, Ishikawa (JP); Takeshi Kimura, Ishikawa (JP)

(73) Assignee: PFU Limited, Ishikawa (JP)

( * ) Notice: Subject to any disclaimer, the term of this patent is extended or adjusted under 35 U.S.C. 154(b) by 418 days.

(21) Appl. No.: 12/019,559

(22) Filed: Jan. 24, 2008

(65) Prior Publication Data

US 2008/0197562 A1 Aug. 21, 2008

(30) Foreign Application Priority Data

Feb. 19, 2007 (JP) ..... 2007-038112

(51) Int. Cl.
*B65H 3/52* (2006.01)

(52) U.S. Cl. ..... 271/125; 271/272

(58) Field of Classification Search ..... 271/272, 271/275, 314, 122, 125, 264, 10.04, 10.05, 271/111, 114, 121; 74/409, 411, 440; 198/781.05; 250/231.13–231.18

See application file for complete search history.

(56) References Cited

U.S. PATENT DOCUMENTS

| | | | | |
|---|---|---|---|---|
| 5,141,346 | A | 8/1992 | Nakagawa | |
| 5,416,395 | A | 5/1995 | Hiramatsu | |
| 6,467,767 | B2 * | 10/2002 | Yano | 271/122 |
| 2007/0096385 | A1 * | 5/2007 | Mandel et al. | 271/122 |

FOREIGN PATENT DOCUMENTS

| | | | |
|---|---|---|---|
| CN | 1360233 | A | 7/2002 |
| CN | 1803562 | A | 7/2006 |
| DE | 41 21 499 | A1 | 1/1992 |
| DE | 691 09 593 | T2 | 11/1995 |
| JP | 06-191018 | | 7/1994 |

OTHER PUBLICATIONS

German Patent Office, Office Action dated Jul. 30, 2008.

Chinese Office Action for Application No. 200810005877.4, issued Nov. 25, 2010.

* cited by examiner

*Primary Examiner* — Stefanos Karmis
*Assistant Examiner* — Michael C McCullough
(74) *Attorney, Agent, or Firm* — Lowe Hauptman Ham & Berner LLP

(57) ABSTRACT

A sheet feeding device includes a driven roller that rotates in response to movement of a sheet, and a rotary encoder that detects a moving distance of the sheet based on rotation of the driven roller. The driven roller and the rotary encoder are connected by a gear unit having backlash. When the sheet moves in a reverse direction and thereby the driven roller rotates in reverse, the rotary encoder does not detect the moving distance of the sheet.

11 Claims, 7 Drawing Sheets

SHEET FEEDING DEVICE

RELATED APPLICATIONS

The present application is based on, and claims priority from, Japan Application Number 2007-038112, filed Feb. 19, 2007, the disclosure of which is hereby incorporated by reference herein in its entirety.

BACKGROUND OF THE INVENTION

1. Field of the Invention

The present invention relates to a sheet feeding device.

2. Description of the Related Art

A commonly-used image forming apparatus, such as a printer, capable of processing a plurality of sheets includes a sheet feeding device. Such an image forming apparatus separates sheets individually from a stack of sheets and sends them one by one to a printing unit. Thus, the stack of sheets can be individually processed and printed. If, however, a sheet is caught somewhere on its transport path and not be transported, a transport error, i.e., feed jam, occurs. This feed jam causes a jam of the subsequent sheets at a location where the feed has occurred. The jammed sheets may all become wasted, or may be sent forward in bundle and result in machinery damage.

Some of those including a sheet feeding device have a mechanism for detecting a transport error. For example, Japanese Patent Application Laid-open No. Heisei 6-191018 discloses a conventional feed-jam detecting device including a feeding sensor that detects a sheet separated from a stack of sheets and transported to an area immediately before a printing unit. The conventional feed-jam detecting device includes a timing switch and a counter that measure elapsed time from the separation of a sheet until the feeding sensor detects the sheet. The conventional feed-jam detecting device also includes a stop-controller that stops feeding of sheets when the feeding sensor does not detect a sheet after an elapse of a predetermined time from the separation of the sheet.

Thus, feeding of sheets stops when the feeding sensor does not detect a sheet because of a feed jam, the number of waste sheets caused by a feed jam can be reduced. Besides, sheets are prevented from being sent forward in bundle, does not cause machinery damage.

As described above, conventional sheet feeding devices include detect a feed jam by a detecting unit, such as the feeding sensor, that detects a sheet transported to a predetermined location. However, a feed jam may not be accurately detected because the occurrence of a feed jam is determined based only on the feeding sensor and the elapsed time. The above conventional feed-jam detecting device measures elapsed time from the separation of a sheet until the feeding sensor detects the sheet, and compares the elapsed time and a predetermined time, i.e., a time expected to be taken, set in advance. Therefore, for example, when a transport speed of a sheet decreases for some reason and the elapsed time unit the feeding sensor detects the sheet exceeds the predetermined time, a feed jam is determined to have occurred even when such a feed jam has not occurred.

On the other hand, when the moving distance is detected and whether the sheet has reached the feeding sensor is judged based on the detected moving distance and a distance to the feeding sensor, whether the feed jam has occurred can be detected more accurately. However, depending on circumstances under which the sheet is being transported, the sheet may move in a direction opposite to a normal moving direction during transport. In this case, an accurate moving distance may not be detected.

SUMMARY OF THE INVENTION

It is an object of the present invention to at least partially solve the problems in the conventional technology.

According to an aspect of the present invention, a sheet feeding device includes: a driven roller that rotates in response to movement of a sheet; a detecting unit that detects a moving distance of the sheet based on rotation of the driven roller; and a dead-zone mechanism that sets a dead zone range in which the detecting unit does not detect the moving distance of the sheet when the driven roller rotates in reverse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
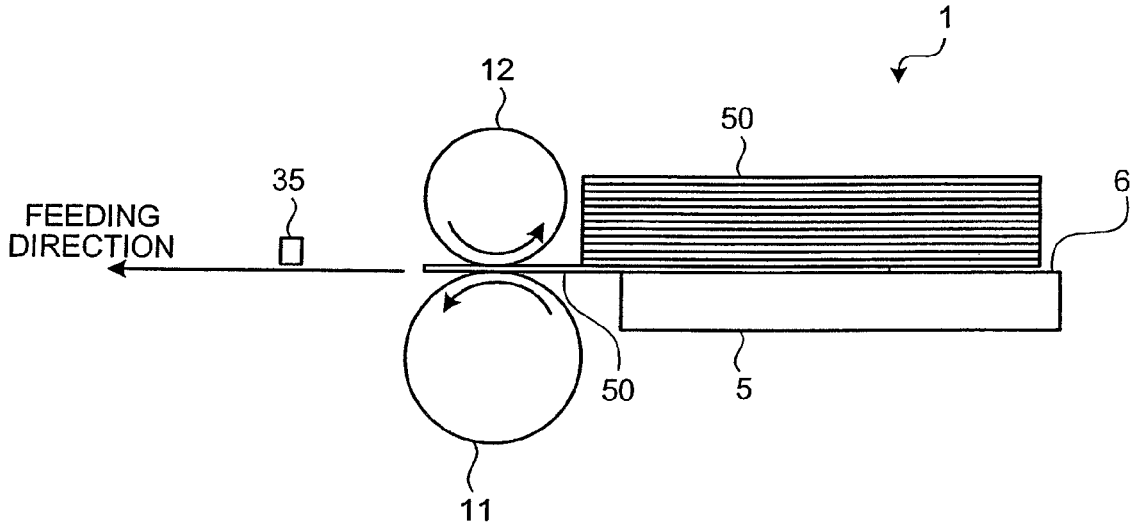
FIG. 1 is a schematic diagram of relevant part of a sheet feeding device according to a first embodiment of the present invention.

FIG. 1 is a schematic diagram of relevant part of a sheet feeding device 1 according to a first embodiment of the present invention. The sheet feeding device 1 includes a feed tray 5 on which recording media (sheets) 50 are placed. The feed tray 5 includes thereon a substantially rectangular loading surface 6. A substantially cylindrical pick roller 11 is arranged near one end of the loading surface 6. The pick roller 11 is a sheet feeding unit. The pick roller 11 is arranged such that a center axis of the pick roller 11 is almost parallel with the loading surface 6 in a width direction of the loading surface 6. Namely, the center axis runs along the loading surface 6 and is perpendicular to a feeding direction of a sheet 50. In other words, the loading surface 6 is substantially rectangular, having four sides along the outer edges. The pick roller 11 is provided near one side, among the four sides, and arranged such that the center axis is almost parallel with a direction in which the side near the pick roller 11 is formed.

A position of the pick roller 11 in a longitudinal direction when the sheet feeding device 1 is being used is such that an upper end of the pick roller 11 is arranged almost on the same plane as the loading surface 6. In other words, a major portion of the pick roller 11 in the longitudinal direction is arranged below the loading surface 6 when the sheet feeding device 1 is being used.

A brake roller 12 for stopping a sheet is arranged near and above the pick roller 11 to face the pick roller 11. Like the pick roller 11, the brake roller 12 is also substantially cylindrical. The brake roller 12 is formed such that a center axis thereof is parallel with the center axis of the pick roller 11. A position of the brake roller 12 in the longitudinal direction when the sheet feeding device 1 is being used is such that a lower end of the brake roller 12 is arranged almost on the same plane as the loading surface 6.

A feeding sensor 35 is provided on the side of the brake roller 12 opposite to the feed tray 5. The feeding sensor 35 is a sheet passage detecting unit detecting a presence of the sheet 50. The feeding sensor 35 detects the sheet 50 transported near the feeding sensor 35 using infrared rays. The feeding sensor 35 can use detect the sheet 50 using a method other than the infrared rays. For example, the feeding sensor 35 can use ultrasonic waves.

The pick roller 11 and the brake roller 12 are connected to a motor (not shown). The pick roller 11 and the brake roller 12 rotate with respective center axes as rotational centers. The pick roller 11 rotates in a direction in which the upper end of the pick roller 11 moves from the feed tray 5 side to the feeding sensor 35 side. The brake roller 12 rotates in a direction in which the lower end of the brake roller 12 moves from the feeding sensor 35 side to the feed tray 5 side.

Figure 2:
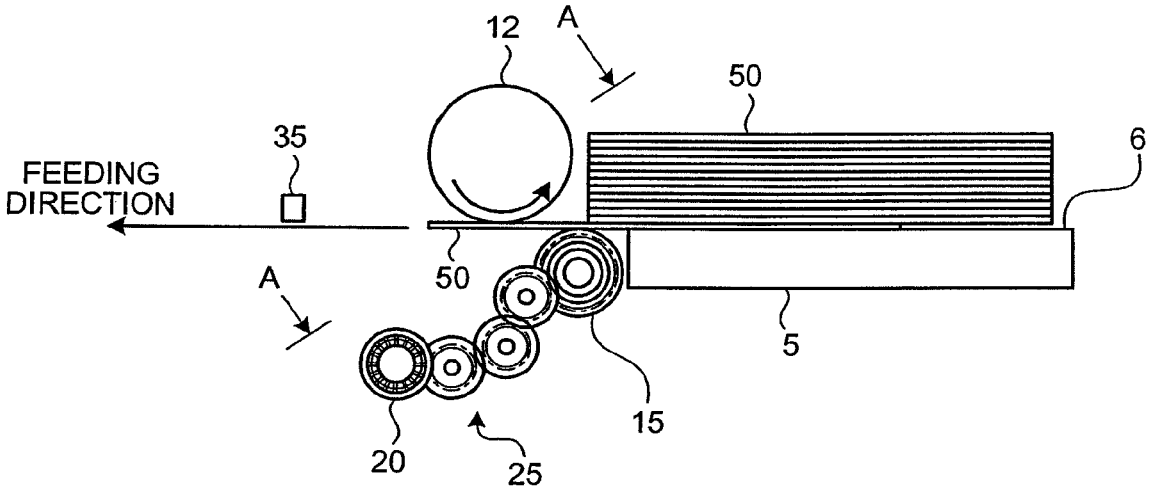
FIG. 2 is another schematic diagram of relevant part of the sheet feeding device in FIG. 1.

FIG. 2 is another schematic diagram of relevant part of the sheet feeding device 1, in which the pick roller 11 is not shown. A substantially disc-shaped driven roller 15 is provided near the feed tray 5, on a side on which the pick roller 11 (see FIG. 1) is provided when the sheet feeding device 1 is viewed from the feed tray 5. Like the pick roller 11, the driven roller 15 is provided such that a center axis of the driven roller 15 is almost parallel with the loading surface 6 in the width direction of the loading surface 6. In other words, all center axes of the driven roller 15, the pick roller 11, and the brake roller 12 are almost parallel.

A position of the driven roller 15 in the longitudinal direction when the sheet feeder device 1 is being used is such that an upper end of the driven roller 15 is arranged almost on the same plane as the loading surface 6. In other words, a major portion of the driven roller 15 in the longitudinal direction when the sheet feeding device 1 is being used is below a bottom side of the loading surface 6.

A gear unit 25 is connected to the driven roller 15 provided as described above. The gear unit 25 includes a plurality of gears. A rotary encoder 20 is connected to the driven roller 15 via the gear unit 25.

Figure 3:
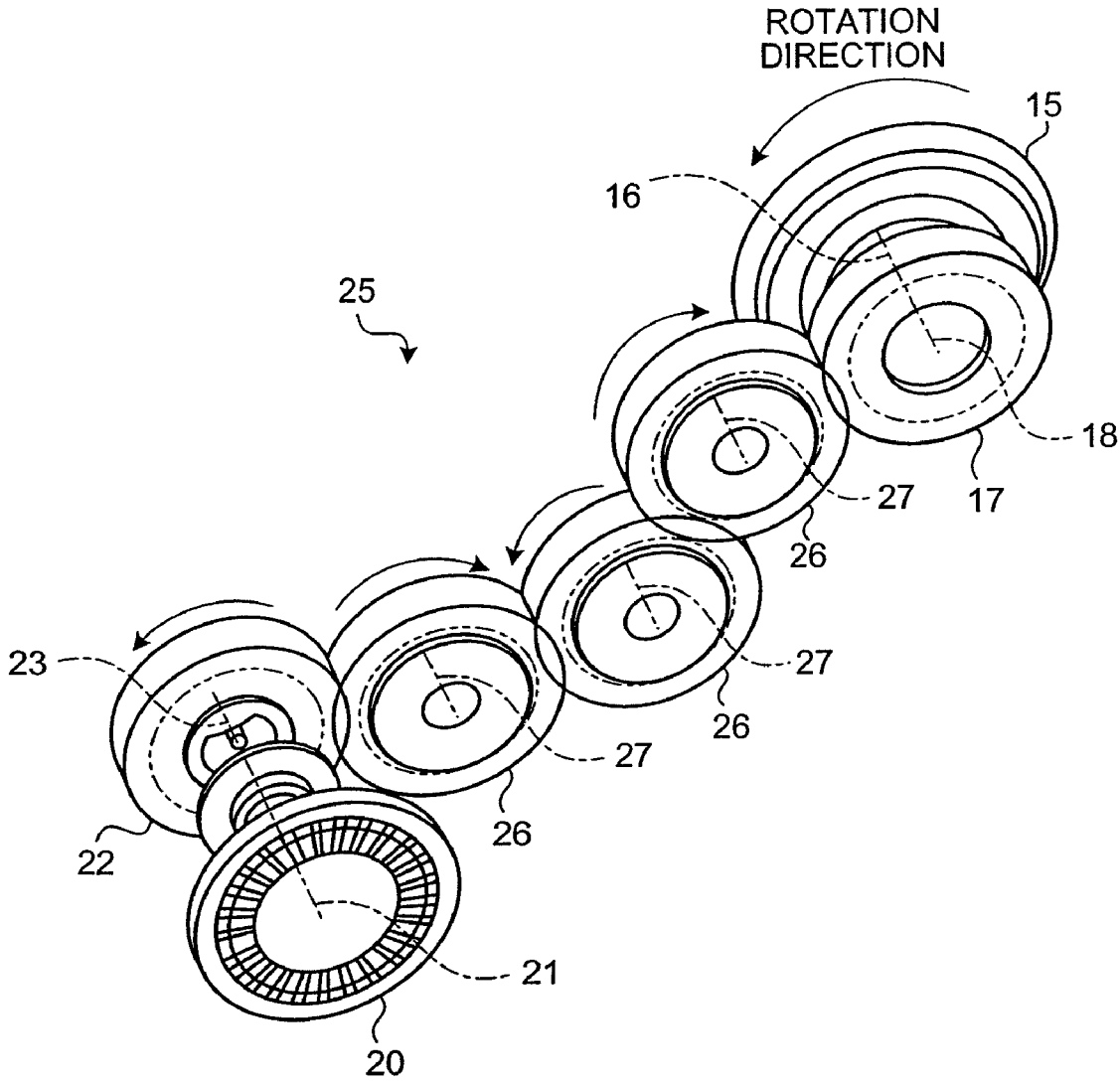
FIG. 3 is a perspective view of a driven roller, a gear unit, and a rotary encoder shown in FIG. 2.

FIG. 3 is a perspective view of the driven roller 15, the gear unit 25, and the rotary encoder 20. The driven roller 15 is integrated with a gear serving as a driven roller gear 17. The driven roller gear 17 is formed such that the driven roller gear 17 rotates on a rotation axis 18 running in the same direction as a center axis 16 of the driven roller 15. The gear unit 25 includes a plurality of gears 26. A rotation axis 27 of each gear is parallel with the rotation axis 18 of the driven roller gear 17. The gears 26 are disposed such as to mesh. The driven roller gear 17 meshes with the gear 26 arranged at an end, among the gears 26 in the gear unit 25.

The rotary encoder 20 has a disc-shaped section in which a plurality of slits are formed around a circumference, with a rotation axis 21 as a center. The rotary encoder 20 rotates on the rotation axis 21 at the center. A light-emitting unit (not shown), such as a light-emitting diode, and a light-receiving unit (not shown), such as a phototransistor, are provided on both sides of the disc-shaped section in the rotation axis 21 direction. As a result, when light emitted from the light-emitting unit passes through the slits, the light-receiving unit can receive the light. When the light emitted from the light-emitting unit is blocked by a section other than the slits in the disc-shaped section, the light-receiving unit cannot receive the light. As a result of the light emitted from the light-emitting unit passing through the slits or being blocked during rotation and the light-receiving unit receiving light or not receiving light in this way, the rotary encoder 20 emits an electrical pulse signal depending on a rotary displacement or an angular speed. The rotary encoder 20 is provided such that the rotation axis 21 is parallel to the rotation axis 18 of the driven roller gear 17.

The rotary encoder 20 is integrated with a gear, as is the driven roller 15. The gear serves as a rotary encoder gear 22. The rotary encoder gear 22 rotates on a rotation axis 23 running in the same direction as the rotation axis 21 of the rotary encoder 20. The rotary encoder gear 22 meshes with the gear 26 arranged in an end, among the gears 26 included in the gear unit 25, as is the driven roller gear 17. The rotary encoder gear 22 meshes with the gear 26 arranged on the end, among the gears 26 in the gear unit 25, as does the driven roller gear 17. The rotary encoder gear 22 meshes with the gear 26 arranged on an end opposite to the gear 26 that meshes with the driven roller gear 17. In other words, the driven roller gear 17 and the rotary encoder gear 22 are connected by the gears 26 included in the gear unit 25.

Figure 4:
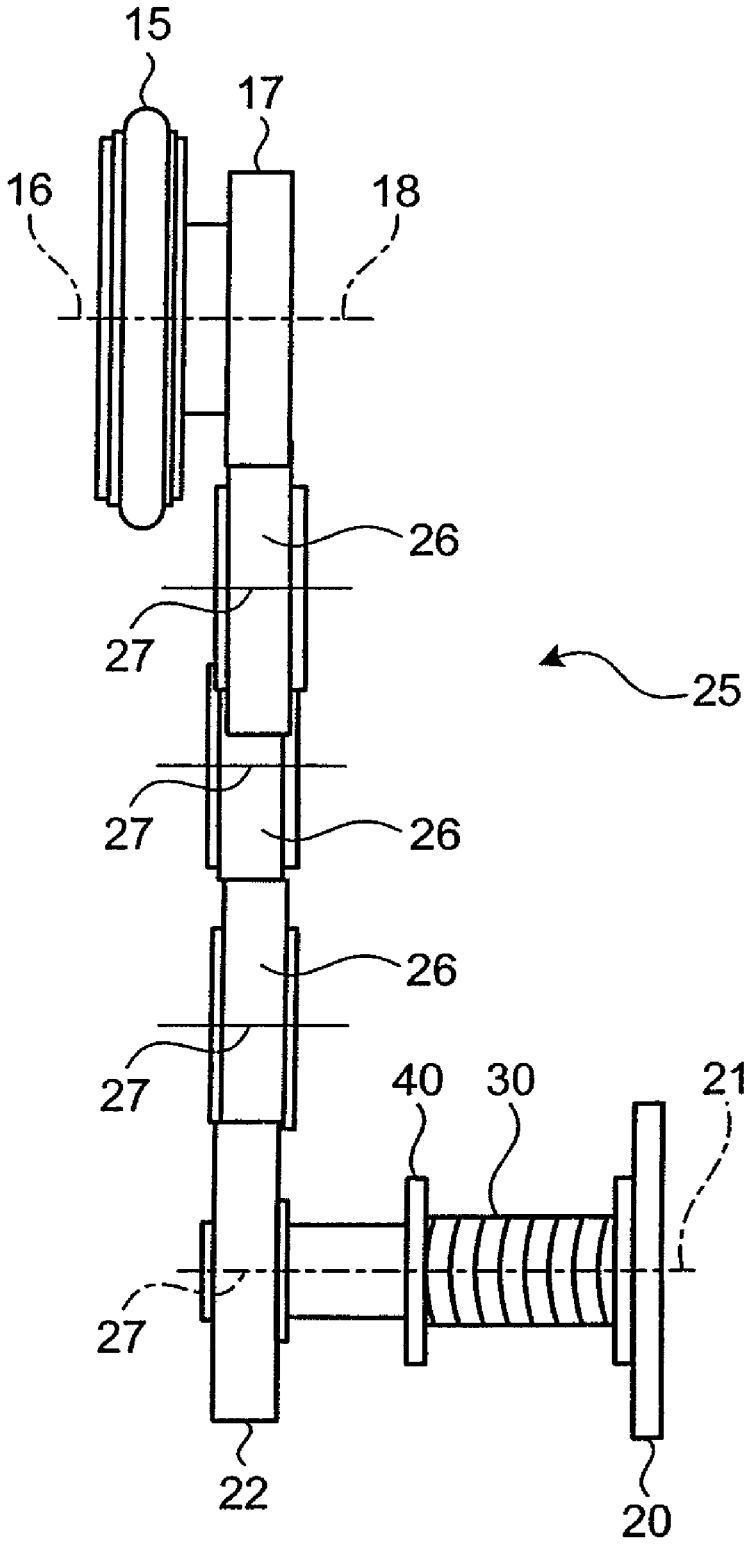
FIG. 4 is a view taken along line A to A in FIG. 2 for explaining the driven roller, the gear unit, and the rotary encoder.

FIG. 4 is a view taken along line A to A in FIG. 2 for explaining the driven roller 15, the gear unit 25, and the rotary encoder 20. The sheet feeding device 1 includes a spring 30. The spring 30 applies a biasing force to the rotary encoder 20 in a direction of the rotation axis 21 of the rotary encoder 20. The spring 30 is arranged between the rotary encoder 20 and a supporting unit 40 supporting the rotary encoder 20. One end of the spring 30 is in contact with the rotary encoder 20. Another end of the spring 30 is in contact with the supporting unit 40. The spring 30 serves as a compression spring applying biasing force to both the rotary encoder 20 and the supporting unit 40 in a direction of the rotation axis 23. The supporting unit 40 is a stationary element included in the sheet feeding device 1. The supporting unit 40 is provided as a bearing that supports the rotary encoder 20.

When the sheet feeding device 1 transports the sheet 50, the sheets 50 are loaded onto the loading surface 6 of the feed tray 5. When the motor connected to the pick roller 11 and the brake roller 12 runs in this state, the pick roller 11 and the brake roller 12 rotate. The pick roller 11 is arranged such that the upper end is almost on the same plane as the loading surface 6. Therefore, when the sheets 50 are loaded onto the loading surface 6, a bottom surface of a bottommost sheet 50 among the loaded sheets 50 comes into contact with the pick roller 11. Therefore, when the pick roller 11 rotates, the sheet 50 in contact with the pick roller 11 moves as a result of the rotation. The pick roller 11 rotates in a direction in which the upper end moves from the feed tray 5 side to the feeding sensor 35 side. The sheet 50 moves in adherence to the rotation of the pick roller 11, in a direction from the loading surface 6 to the feeding sensor 35.

When the sheet 50 moves as described above, a single sheet 50 or a plurality of sheets 50, among the sheets 50 excluding the sheet 50 in contact with the pick roller 11, moves in the same direction with the movement of the sheet 50 in contact with the pick roller 11, as a result of frictional force between the sheets 50. In other words, when the sheet 50 in contact with the pick roller 11 moves as a result of the rotation of the pick roller 11, a portion of the sheets 50 loaded on top of the sheet 50 also moves in the same direction with the movement of the sheet 50 in contact with the pick roller 11. However, the brake roller 12 is arranged above the pick roller 11. Therefore, the sheet 50 comes into contact with the brake roller 12.

The brake roller 12 is arranged such that the lower end is almost on the same plane as the loading surface 6. The brake roller 12 rotates in a direction in which the lower end moves from the feeding sensor 35 side to the feed tray 5 side. In other words, the brake roller 12 rotates in a direction in which a surface on the lower end side opposing the pick roller 11 moves in a direction opposite to the direction in which the upper end of the pick roller 11 moves.

Therefore, when the sheets 50 loaded on top of the sheet 50 in contact with the pick roller 11 moves in the same direction with the movement of the sheet 50 and come into contact with the brake roller 12, the sheets 50 that are in contact with the brake roller 12 stop moving as a result of the rotation of the brake roller 12. Therefore, only the sheet 50 in contact with the pick roller 11 moves in a direction of the feeding sensor 35.

When the sheet 50 in contact with the pick roller 11 moves in the direction of the feeding sensor 35 and separates from the pick roller 11 in this way, the pick roller 11 comes into contact with a next sheet 50 arranged immediately above the sheet 50 from a bottom surface of the next sheet 50. The operations described above are repeated. The sheets 50 are individually transported in the feeding direction as a result of the operations being repeated.

The sheets 50 loaded onto the feed tray 5 move in the feeding direction, one sheet at a time, as a result of the rotations of the pick roller 11 and the brake roller 12. The driven roller 15 is arranged near the feed tray 5 on the side on which the pick roller 11 is provided. The upper end of the driven roller 15 is on the same plane as the loading surface 6, as is the pick roller 11. Therefore, when the sheet 50 is transported, the driven roller 15 comes into contact with the sheet 50 from bottom surface of the sheet 50.

Neither a rotational force nor a stopping force generated by a motor and the like is applied to the driven roller 15. Therefore, when the sheet 50 of which the bottom surface is in contact with the driven roller 15 is transported and moves, the driven roller 15 rotates, following the sheet 50. When the driven roller 15 rotates as described above, the driven roller gear 17 also rotates because the driven roller gear 17 and the driven roller 15 are integrated. The driven roller gear 17 meshes with the gear 26 in the gear unit 25. Therefore, when the driven roller gear 17 rotates, the rotation is transmitted to the gear 26 meshing with the driven roller gear 17 in the gear unit 25.

When the rotation is transmitted from the driven roller gear 17 to the gear 26 in the gear unit 25 in this way, the rotation is transmitted among the gears 26 in the gear unit 25. All gears 26 in the gear unit 25 rotate. The gear 26 in the gear unit 25 meshes with the rotary encoder gear 22 integrated with the rotary encoder 20. Therefore, the rotation of the gear 26 in the gear unit 25 is transmitted to the rotary encoder gear 22. The rotary encoder gear 22 and the rotary encoder 20 rotate.

The rotary encoder 20 emits the electrical pulse signal in response to the rotary displacement occurring as a result of the rotation. Therefore, when the rotary encoder 20 rotates, the rotary displacement can be detected by detecting the pulse signal emitted from the rotary encoder 20. The rotation of the rotary encoder 20 corresponds to the rotation of the driven roller 15 transmitted via the gear unit 25.

The driven roller 15 rotates as a result of the movement of the sheet 50 in contact with the driven roller 15. Therefore, the rotary displacement of the rotary encoder 20 occurring when the rotary encoder 20 rotates corresponds to the moving distance of the sheet 50. The moving distance of the sheet 50 can be detected by the rotary displacement of the rotary encoder 20 being detected. Therefore, the rotary encoder 20 detects the moving distance of the sheet 50 as a result of the rotation of the driven roller 15 being transmitted to the rotary encoder 20.

The feeding sensor 35 is provided in a moving direction of the sheet 50 transported by the rotation of the pick roller 11. Therefore, when the sheet 50 reaches a position at which the feeding sensor 35 is provided by moving in the feeding direction, the feeding sensor 35 detects the sheet 50. In this way, the rotary encoder 20 detects the moving distance of the sheet 50. The feeding sensor 35 detects the presence of the sheet 50. Therefore, the feed jam in which the sheets 50 are jammed is detected based on detection results from the rotary encoder 20 and the feeding sensor 35.

In other words, when the feed jam occurs, the sheet 50 does not move to the position at which the feeding sensor 35 is disposed even when the pick roller 11 moves the sheet 50. Therefore, in this instance, the feed jam can be judged to have occurred. Specifically, when the rotary encoder 20 detects the moving distance of the sheet 50 and the feeding sensor 35 detects the sheet 50 before the sheet 50 moves over a predetermined distance, the feed jam is judged to have not occurred. On the other hand, when the rotary encoder 20 detects the moving distance of the sheet 50 and the feeding sensor 35 does not detect the sheet 50 before the sheet 50 moves over the predetermined distance, the sheet 50 is not moving normally. The feed jam is judged to have occurred.

Whether the feed jam has occurred is judged based on the detection results from the feeding sensor 35 and the rotary encoder 20, as described above. The rotary encoder 20 emits the electrical pulse signal in the same manner, regardless of the direction in which the rotary encoder 20 rotates. Therefore, for example, when the driven roller 15 is directly connected to the rotary encoder 20 and the rotation of the driven roller 15 is directly transmitted to the rotary encoder 20, when the sheet 50 in contact with the driven roller 15 moves in a direction opposite to an ordinary feeding direction, the rotary encoder 20 emits the same electrical pulse signal as when the sheet 50 is moving in the ordinary feeding direction. In this case, an accurate moving distance of the sheet 50 cannot be detected.

Figure 5:
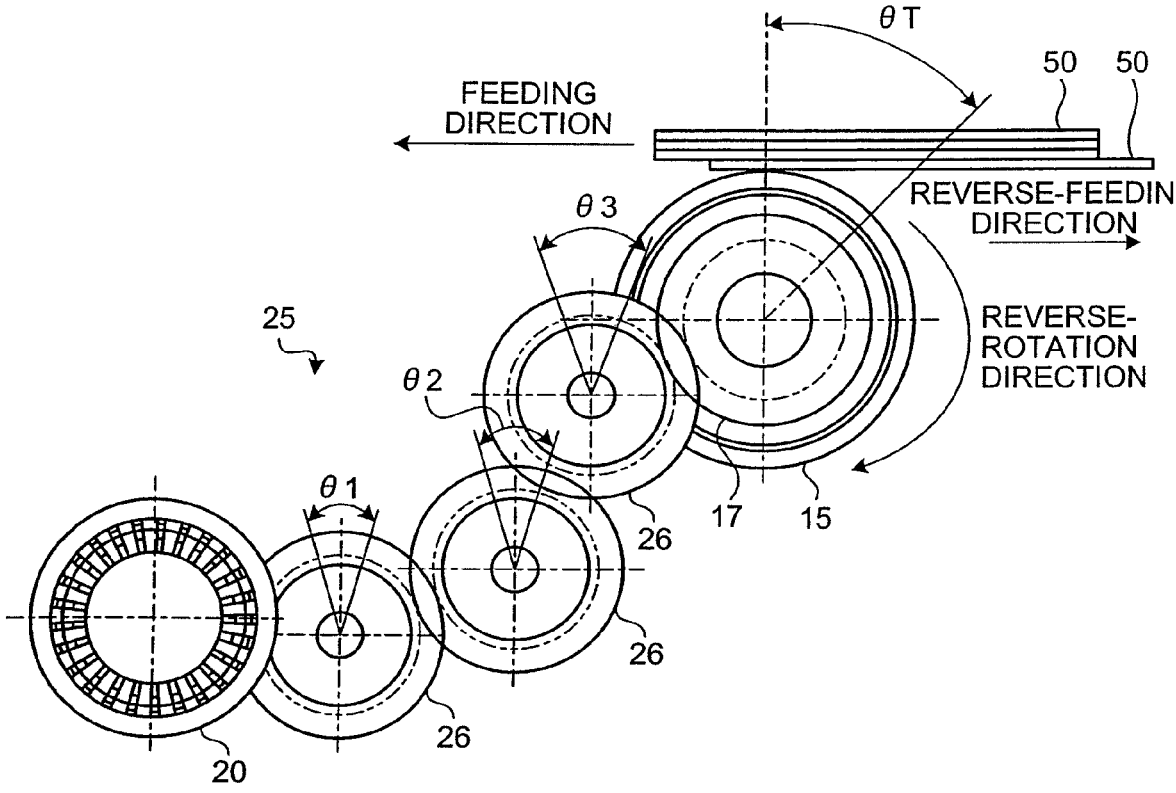
FIG. 5 is a schematic diagram for explaining a case where a sheet moves in a direction opposite to a feeding direction in the sheet feeding device shown in FIG. 1.

FIG. 5 is a schematic diagram for explaining a case where the sheet 50 moves in the direction opposite to the feeding direction in the sheet feeding device 1. When the rotary encoder 20 is directly connected to the driven roller 15, the rotary encoder 20 emits the pulse signals in the same manner, regardless of the movement direction of the sheet 50. In the sheet feeding device 1, the gear unit 25 is located between the driven roller 15 and the rotary encoder 20, and therefore, the rotation of the driven roller 15 is transmitted to the rotary encoder 20 via the gear unit 25. The gear unit 25 is a combination of the meshed gears 26 having backlash.

In other words, the gears 26 mesh with one another with backlash in the rotation direction. Backlash such as this is generated when a direction in which the gears 26 rotate change. Therefore, when there is no change in direction of the rotation transmitted from the driven roller 15 via the gear unit 25 to the rotary encoder 20 while the sheet 50 is moving in the feeding direction, backlash does not occur. As a result, the moving distance of the sheet 50 detected by the rotation of the driven roller 15 being transmitted to the rotary encoder 20, via the gear unit 25, can be accurately detected.

On the other hand, when the sheet 50 moves in a reverse-feeding direction opposite to the ordinary feeding direction, the driven roller 15 that rotates following the sheet 50 rotates in a direction opposite to a rotation direction when the sheet 50 is moving in the ordinary feeding direction. In other words, the driven roller 15 rotates in reverse. When the driven roller 15 rotates in reverse, is generated as a result of the backlash between each gear 26 in the gear unit 25, between the gear 26 in the gear unit 25 and the driven roller gear 17, and between the gear 26 in the gear unit 25 and the rotary encoder gear 22.

When one of a plurality of gears serves as a reference point, the total backlash of the gears is obtained based on the reference point. Specifically, when the gear unit 25 has three gears 26 as in the sheet feeding device 1 and the rotary encoder gear 22 serves as the reference point, the backlash increases as a distance from the rotary encoder gear 22 increases. In other words, when sizes of the backlash between inter-meshing gears, from the rotary encoder gear 22 to the three gears 26 in the gear unit 25 and towards the driven roller gear 17, are θ1, θ2, θ3, and θT, the backlash increases from θ1 towards θT.

In this way, when the rotary encoder gear 22 serves as the reference point, the backlash increases as the distance from the rotary encoder gear 22 increases. Therefore, an angle of the backlash increases from the θ1 towards the θT. Thus, even when the rotary encoder gear 22 is configured not to rotate in reverse, the driven roller gear 17 can rotate in reverse at a wide angle.

In other words, the driven roller 15 can rotate in reverse at a wide angle even when the rotary encoder 20 is configured not to rotate in the opposite direction of the ordinary rotation direction. Therefore, the rotary encoder 20 does not rotate even when the sheet 50 in contact with the driven roller 15 moves in the reverse-feeding direction and the driven roller 15 rotates in reverse. As a result, the moving distance of the sheet 50 is not detected.

A range over which the rotary encoder 20 does not detect the moving distance of the sheet 50 when the driven roller 15 is rotating in reverse is a dead zone range. In other words, when the rotary encoder 20 is stopped, θT that is a range over which the driven roller 15 can rotate in reverse is the dead zone range. The dead zone range is set as a result of a reverse rotation of the driven roller 15 not being transmitted to the rotary encoder 20 because of the backlash in the gears 26. In this way, the gear unit 25 is a dead-zone mechanism that transmits the rotation of the driven roller 15 to the rotary encoder 20 and provides the dead zone range by including the gears 26 having backlash.

The reverse rotation of the rotary encoder 20 is made more difficult by the biasing force from the spring 30, provided between the rotary encoder 20 and the supporting unit 40. As a result, the rotary encoder 20 has difficulty in rotating in reverse even when the sheet 50 moves in the reverse-feeding direction. Therefore, the rotary encoder 20 has difficulty in detecting the moving distance of the sheet 50 moving in the reverse-feeding direction.

The sheet feeding device 1, as described above, includes the rotary encoder 20 that detects the moving distance of the sheet 50 through the rotation of the driven roller 15 rotating such as to follow the sheet 50. Therefore, the sheet feeding device 1 can detect the moving distance of the sheet 50. The sheet feeding device 1 further includes the dead zone range mechanism. Therefore, when the sheet 50 moves in the reverse-feeding direction opposite to the ordinary feeding direction and the driven roller 15 rotates in reverse, the rotary encoder 20 is configured such as not to detect the moving distance of the sheet 50 within a predetermined range. As a result, the judgment on whether the feed jam has occurred can be made based on the moving distance of the sheet 50. Because the moving distance when the sheet 50 moves in the reverse-feeding direction is not detected, decline in accuracy when the moving distance of the sheet 50 is detected can be reduced, thereby allowing the feed jam to be more accurately detected.

The gears 26 are provided between the driven roller 15 and the rotary encoder 20. The rotation of the driven roller 15 can be transmitted to the rotary encoder 20, via the gears 26. The gears 26 have backlash. Therefore, when the driven roller 15 rotates in reverse, the rotation of the driven roller 15 is absorbed by the backlash and is not transmitted to the rotary encoder 20. In other words, the dead zone range is set by the backlash. Therefore, the rotary encoder 20 can be prevented with more certainty from detecting the moving distance when the sheet 50 moves in the reverse-feeding direction.

The driven roller 15 and the rotary encoder 20 are connected by the gears 26. Therefore, when space near the sheet 50 is narrow and the rotary encoder 20 cannot be set near the sheet 50, the rotation of the driven roller 15 can be transmitted to the rotary encoder 20 arranged away from the sheet 50. As a result, the feed jam can be more accurately detected and the rotary encoder 20 can be set with ease.

The spring 30 applies biasing force to the rotary encoder 20. Therefore, when the driven roller 15 rotates in reverse when the dead zone range is set by the gear unit 25 that is the dead-zone mechanism, the rotation of the rotary encoder 20 can be prevented with further certainty. As a result, when the sheet 50 moves in the reverse-feeding direction and the driven roller 15 rotates in reverse, the rotary encoder 20 can be prevented with further certainty from detecting the moving distance of the sheet 50 within the predetermined range. As a result, the feed jam can be more accurately detected.

Figure 6:
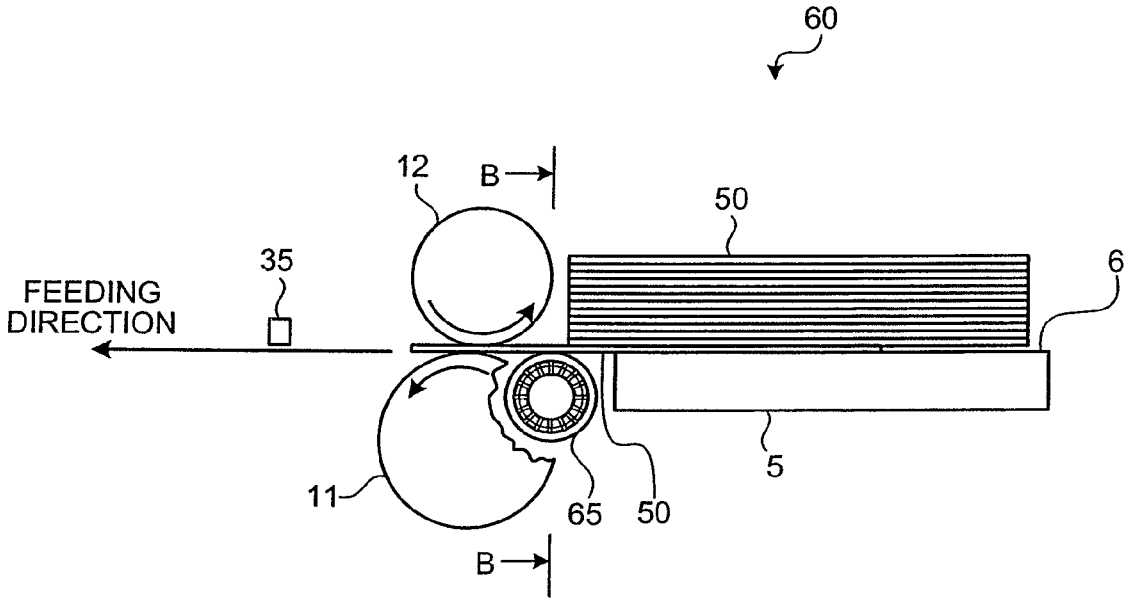
FIG. 6 is a schematic diagram of relevant part of a sheet feeding device according to a second embodiment of the invention.

FIG. 6 is a schematic diagram of relevant part of a sheet feeding device 60 according to a second embodiment of the present invention. The sheet feeding device 60 is of basically the same configuration and operates in a similar manner as the sheet feeding device 1 except that the dead-zone mechanism includes a protruding portion and a recessed portion. Therefore, like reference numerals refer to corresponding portions, and the same explanation is not repeated. The sheet feeding device 60 includes the pick roller 11, the brake roller 12, and the feed tray 5 on which the sheets 50 can be placed, as does the sheet feeding device 1. The feeding sensor 35 is provided on the side opposite to the feed tray 5 when viewed from the pick roller 11 and the brake roller 12. The sheet feeding device 60 further includes a driven roller 65 near the feed tray 5 and on the side on which the pick roller 11 is arranged when the sheet feeding device 60 is viewed from the feed tray 5, as does the sheet feeding device 1.

Figure 7:
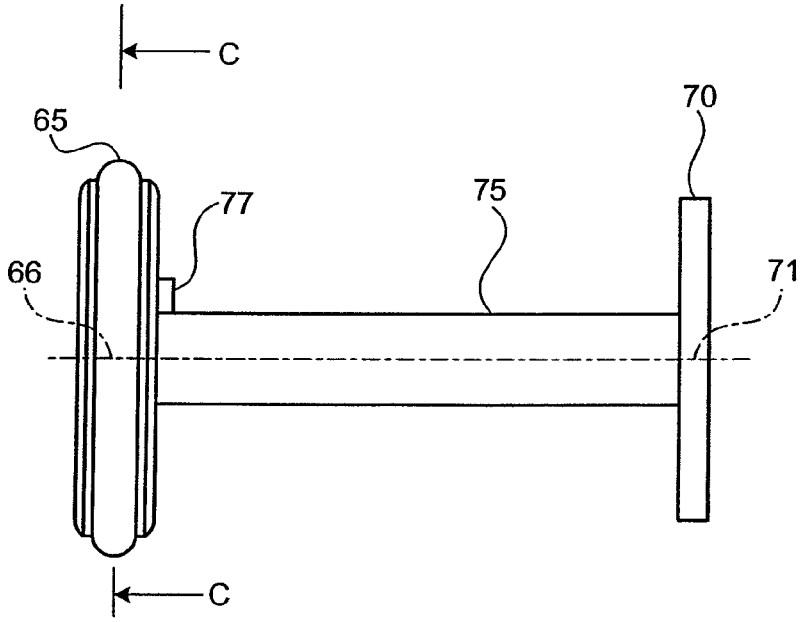
FIG. 7 is a view taken along line B to B in FIG. 6.
Figure 8:
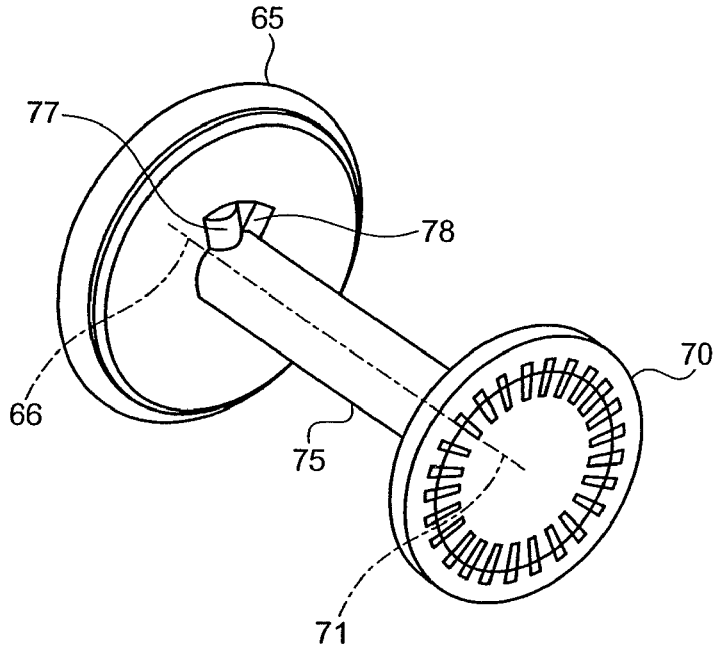
FIG. 8 is a perspective view of a driven roller and a rotary encoder shown in FIG. 7.
Figure 9:
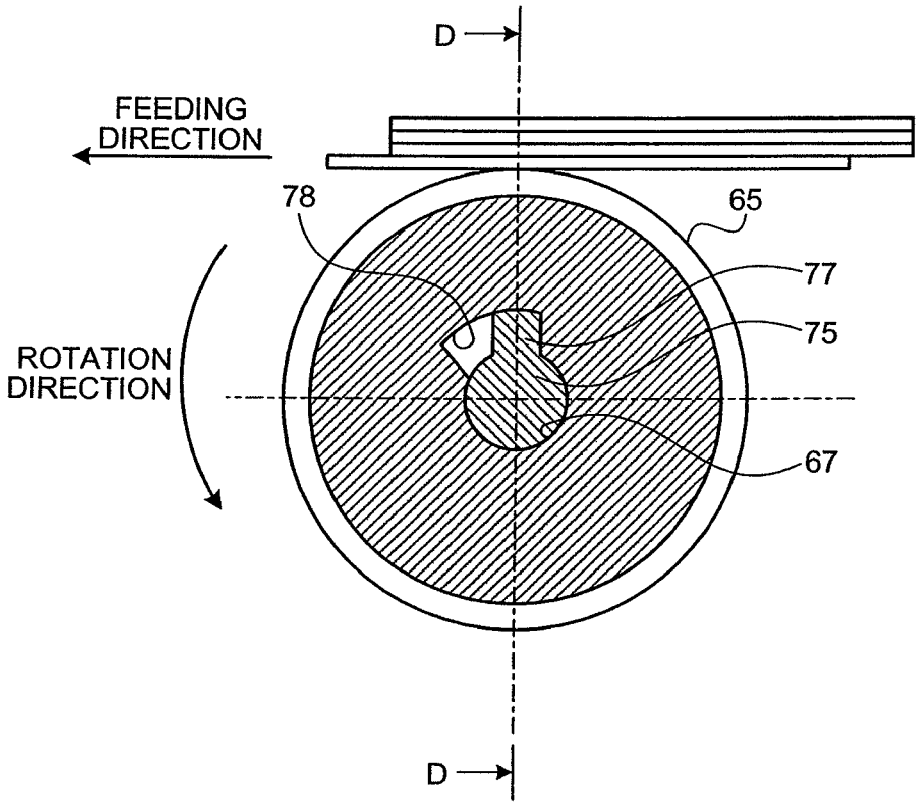
FIG. 9 is a cross-sectional view taken along line C to C in FIG. 7.
Figure 10:
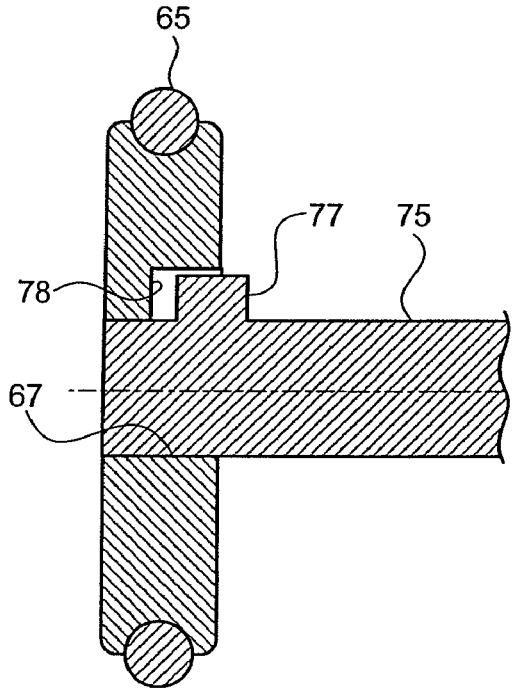
FIG. 10 is a cross-sectional view taken along line D-D in FIG. 9.

FIG. 7 is a view taken along line B to B in FIG. 6. FIG. 8 is a perspective view of the driven roller 65 and a rotary encoder 70. FIG. 9 is a cross-sectional view taken along line C to C in FIG. 7. FIG. 10 is a cross-sectional view taken along line D-D in FIG. 9. The sheet feeding device 60 includes the rotary encoder 70 in a different manner than the rotary encoder 20 in the sheet feeding device 1 described previously in the first embodiment. The rotary encoder 70 is connected to a substantially cylindrical shaft 75 formed in a direction of a rotation axis 71 of the rotary encoder 70. The shaft 75 and the rotary encoder 70 are integrated. In other words, the rotary encoder 70 is connected to one end of the shaft 75.

The driven roller 65 is arranged on another end of the shaft 75. The shaft 75 and the driven roller 65 are connected as follows. A connection hole 67 penetrating the driven roller 65 is formed on the driven roller 65. The shaft 75 is inserted into the connection hole 67. When the shaft 75 is connected to the driven roller 65 in this way, the driven roller 65 and the rotary encoder 70 are formed such that a center axis 66 of the driven roller 65 and the rotation axis 71 of the rotary encoder 70 are collinear.

A protruding portion 77 and a recessed portion 78 that can be engaged are formed on the shaft 75 and the connection hole 67. The protruding portion 77 is formed on the shaft 75 near a portion inserted into the connection hole 67. The protruding portion 77 projects in a radial direction of the shaft 75. The recessed portion 78 is formed such as to surround an outer side of the connection hole 67 in the radial direction. In other words, the recessed portion 78 is formed such that a portion of the connection hole 67 is cut away. A width of the recessed portion 78 is wider than a width of the protruding portion 77 in a rotational direction of the shaft 75 and the driven roller 65. Therefore, when the shaft 75 is inserted into the connection hole 67, and the protruding portion 77 is inserted into the recessed portion 78 and engaged with the recessed portion 78, a clearance is formed between the protruding portion 77 and the recessed portion 78 in the rotational direction of the driven roller 65.

When the sheet feeding device 60 transports the sheet 50, opposing surfaces of the pick roller 11 and the brake roller 12 rotate each other in opposite directions as with the sheet feeding device 1. As a result, the sheets 50 loaded onto the loading surface 6 of the feed tray 5 are transported, one sheet at a time. The driven roller 65 comes into contact with the sheet 50 transported as described above and rotates following the sheet 50.

When the driven roller 65 rotates, the recessed portion 78 formed on the connection hole 67 of the driven roller 65 engages with the protruding portion 77 of the shaft 75. A force generated during the rotation of the driven roller 65 is transmitted from the recessed portion 78 to the protruding portion 77. As a result, the rotation of the driven roller 65 is transmitted to the shaft 75.

Here, the protruding portion 77 and the recessed portion 78 have the clearance in the rotation direction of the driven roller 65. When the force generated during the rotation of the driven roller 65 is transmitted from the recessed portion 78 to the protruding portion 77, the force in the rotation direction is transmitted from an upstream side in the rotation direction. Therefore, the upstream side in the rotation direction of the protruding portion 77 and the recessed portion 78 come into contact. The clearance between the protruding portion 77 and the recessed portion 78 is arranged downstream of the protruding portion 77 in the rotation direction.

The shaft 75 to which the rotation is transmitted from the driven roller 65 in this way is integrated with the rotary encoder 70. Therefore, the rotary encoder 70 also rotates when the shaft 75 rotates. As a result, the rotation of the driven roller 65 rotating with the movement of the sheet 50 in contact with the driven roller 65 is transmitted to the rotary encoder 70. The moving distance of the sheet 50 can be detected by a rotary displacement of the rotary encoder 70 being detected.

The feeding sensor 35 is provided in the feeding direction of the sheet 50. Therefore, as in the first embodiment, the feed jam can be detected by the rotary encoder 70 detecting the moving distance of the sheet 50 and the feeding sensor 35 detecting the presence of the sheet 50.

Because the rotary encoder 70 is used to detect the moving distance of the sheet 50, as in the first embodiment, the dead zone range is also provided in the sheet feeding device 60.

Figure 11:
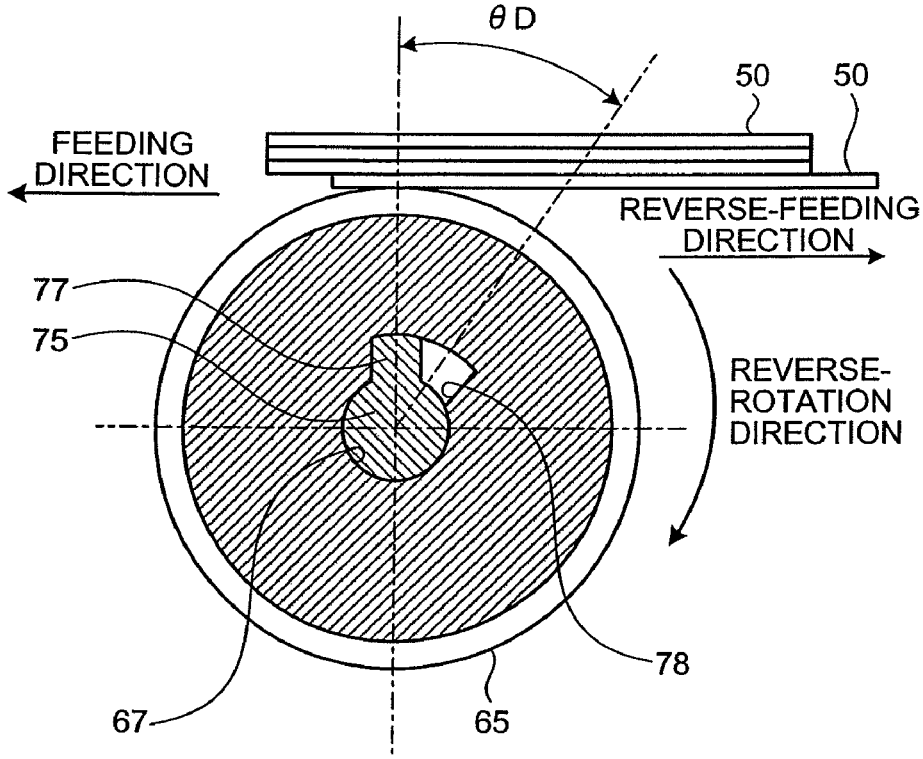
FIG. 11 is a cross-sectional view of the driven roller for explaining a case where a sheet moves in a direction opposite to a feeding direction in the sheet feeding device shown in FIG. 6.

FIG. 11 is a cross-sectional view of the driven roller 65 for explaining a case where the sheet 50 travels in the direction opposite to the feeding direction in the sheet feeding device 60. When the sheet 50 moves in the reverse-feeding direction opposite to the feeding direction, the driven roller 65 that rotates following the movement of the sheet 50 rotates in reverse. When the driven roller 65 rotates in reverse, the recessed portion 78 formed in the connection hole 67 of the driven roller 65 also rotates in the reverse direction as does the driven roller 65. When the protruding portion 77 engages with the recessed portion 78, the clearance is formed between the recessed portion 78 and the protruding portion 77 in the rotation direction of the driven roller 65.

When the driven roller 65 rotates in the ordinary rotation direction, the clearance is arranged downstream of the protruding portion 77 in the rotation direction. However, when the driven roller 65 rotates in reverse, the recessed portion 78 rotates in a direction in which the clearance narrows.

On other words, when the driven roller 65 rotating in the ordinary rotation direction rotates in reverse, the clearance is arranged upstream of the driven roller 65 in the direction of the reverse rotation. However, the clearance narrows as a result of the recessed portion 78 rotating in the reverse-rotation direction, and a clearance is formed downstream of the protruding portion 77 in the direction of the reverse rotation. Therefore, the recessed portion 78 and the protruding portion 77 do not come into contact in the rotation direction of the driven roller 65. The recessed portion 68 and the driven roller 65 on which the recessed portion 78 is formed rotate in reverse. Thus, when the driven roller 65 rotates in reverse, the clearance formed upstream of the protruding portion 77 in the direction of the reverse rotation closes. Until the recessed portion 78 and the protruding portion 77 come into contact, the driven roller 65 rotates in reverse without the force generated by the rotation being transmitted to the protruding portion 77.

In this way, when the driven roller 65 that rotates following the movement of the sheet 50 in the feeding direction rotates in reverse as a result of the sheet 50 moving in the reverse-feeding direction, the shaft 75 does not rotate within a range until the recessed portion 78 and the protruding portion 77 come into contact in the direction of the reverse rotation. Therefore, the rotary encoder 70 also stops rotating. The rotation of the driven roller 65 is transmitted to the rotary encoder 70 via the shaft 75, by the recessed portion 78 and the protruding portion 77 between which the clearance is formed. Therefore, when the driven roller 65 rotates in reverse, the rotary encoder 70 does not rotate within a predetermined range. The predetermined range is a delay range θD. The rotary encoder 70 does not rotate within the delay range θD. Therefore, the moving distance of the sheet 50 is also not detected within the delay range θD. The delay range θD is set as the dead zone range. In other words, the delay range θD that is the dead zone range is set by the reverse rotation of the driven roller 65 not being transmitted to the rotary encoder 70 as a result of the clearance between the protruding portion 77 and the recessed portion 78.

The recessed portion 78 is formed on the driven roller 65 side and the protruding portion 77 is formed on the shaft 75 on the rotary encoder 70 side. The recessed portion 78 and the protruding portion 77 engage and transmit the rotation of the driven roller 65 to the rotary encoder 70. Furthermore, the recessed portion 78 and the protruding portion 77 serve as the dead-zone mechanism setting the dead zone range by having the clearance in the rotation direction of the driven roller 65 when engaged.

In the sheet feeding device 60 described above, the rotation of the driven roller 65 is transmitted to the rotary encoder 70 as a result of the protruding portion 77 and the recessed portion 78, formed divided into the driven roller 65 side and the rotary encoder 70 side, engaging. The recessed portion 78 and the protruding portion 77 have the clearance when the recessed portion 78 and the protruding portion 77 are engaged. Therefore, when the driven roller 65 rotates in reverse, the rotation of the driven roller 65 is absorbed by the clearance and is not transmitted to the rotary encoder 70. Thus, the rotary encoder 70 can be prevented with more certainty from detecting the moving distance when the sheet 50 moves in the reverse-feeding direction. As a result, the feed jam can be more accurately detected.

The dead zone range is provided by the protruding portion 77 and the recessed portion 78, between which the clearance is formed when the protruding portion 77 and the recessed portion 78 are engaged. Therefore, the dead-zone mechanism setting the dead zone range within which the rotary encoder 70 does not detect the moving distance of the sheet 50 when the driven roller 65 rotates in reverse can be easily provided. As a result, a configuration allowing an accurate detection of the feed jam can be easily provided.

In the description above, a pair of the recessed section 78 formed on the driven roller 65 and the protruding portion 77 formed on the shaft 75 on the rotary encoder 70 side is provided. However, a plurality of pairs of the recessed portion 78 and the protruding portion 77 can be provided. The recessed portion 78 is formed on the driven roller 65. The protruding portion is formed on the shaft 75 on the rotary encoder 70 side. However, the recessed portion 78 can be formed on the rotary encoder 70 side and the protruding portion 77 on the driven roller 65 side. The number of protruding portions 77 and recessed portions 78 and the positions at which they are provided are unimportant as long as the protruding portion 77 and the recessed portion 78 can transmit the rotation of the driven roller 65 to the rotary encoder 70 when the protruding portion 77 and the recessed portion 78 are engaged and the clearance in the rotation direction of the driven roller 65 is provided when the protruding portion 77 and the recessed portion 78 are engaged.

The sheet feeding device 1 includes the spring 30 serving as a biasing unit applying a bias force to the rotary encoder 20 in the rotation axis 21 direction of the rotary encoder 20. The sheet feeding device 60 can also be provided with a biasing unit such as this. With the spring (biasing unit) 30, the rotation of the rotary encoder 70 driven roller becomes difficult when the driven roller 65 rotates in reverse as in the first embodiment. Therefore, when the sheet 50 moves in the reverse-feeding direction and the driven roller 65 rotates in reverse, the rotary encoder 70 can be prevented with more certainty from detecting the moving distance of the sheet 50. As a result, the feed jam can be accurately detected.

In the description above, the pick roller 11 and the brake roller 12 are used for transporting the sheet 50. However, other components can be used for transporting the sheet 50. Regardless of the means for feeding the sheet 50, the moving distance of the sheet 50 can be detected when it is transported while the moving distance is not detected when the sheet 50 moves in the reverse-feeding direction with the driven roller 15 (65), the dead-zone mechanism, and a moving distance detecting unit such as the rotary encoder 20 (70). As a result, the feed jam can be more accurately detected.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device, comprising:

a pick roller that is rotatable to feed a sheet;

a brake roller that is rotatable in the same rotational direction as the pick roller to stop the sheet:

a driven roller that is separate from the pick roller and the brake roller, and rotatable in response to movement of the sheet;

a detecting unit for detecting a moving distance of the sheet based on rotation of the driven roller; and a dead-zone mechanism that is arranged between the driven roller and the detecting unit and defines a dead zone range in which the detecting unit does not detect the moving distance of the sheet when the driven roller rotates in reverse.

2. The sheet feeding device according to claim 1, wherein the dead-zone mechanism includes a plurality of gears having backlash for transmitting the rotation of the driven roller to the detecting unit; and the plurality of gears is arranged, due to the backlash, to not transmit reverse rotation of the driven roller to the detecting unit, to whereby define the dead zone range.

3. The sheet feeding device according to claim 1, wherein the dead-zone mechanism includes a recessed portion on a driven roller side and a protruding portion on a detecting unit side, the protruding portion engages the recessed portion with a clearance in a direction in which the driven roller rotates; and the clearance between the protruding portion and the recessed portion is arranged to not transmit reverse rotation of the driven roller to the detecting unit to whereby define the dead zone range.

4. The sheet feeding device according to claim 1, further comprising a biasing unit that applies a biasing force to the detecting unit in a direction of a rotation axis of the detecting unit.

5. The sheet feeding device according to claim 1, wherein the driven roller is passively driven at all times.

6. The sheet feeding device according to claim 1, wherein the driven roller is positioned, in a feeding direction of the sheet, upstream of said pick roller.

7. The sheet feeding device according to claim 1, wherein the driven roller is positioned, in a feeding direction of the sheet, upstream of said brake roller.

8. The sheet feeding device according to claim 1, wherein the driven roller is positioned, in a feeding direction of the sheet, upstream of both said pick and brake rollers.

9. The sheet feeding device according to claim 1, wherein reverse rotation of the driven roller is caused by a movement of the sheet in a direction opposite to a feeding direction.

10. A sheet feeding device, comprising:

a driven roller that rotates in response to movement of a sheet;

a detecting unit that detects a moving distance of the sheet based on rotation of the driven roller; and a dead-zone mechanism that sets a dead zone range in which the detecting unit does not detect the moving distance of the sheet when the driven roller rotates in reverse;

wherein the dead-zone mechanism transmits the rotation of the driven roller to the detecting unit, and includes a plurality of gears having backlash; and the plurality of gears is arranged, due to the backlash, to not transmit reverse rotation of the driven roller to the detecting unit to whereby provide the dead zone range.

11. The sheet feeding device according to claim 10, further comprising:

a biasing unit that applies a biasing force to the detecting unit in a direction of a rotation axis of the detecting unit.

* * * * *